United States Patent [19]

Baeck et al.

[11] Patent Number: 4,744,911

[45] Date of Patent: May 17, 1988

[54] DISPERSIBLE FABRIC SOFTENERS

[75] Inventors: Andre Baeck, Bonheiden; Alfred Busch, Grimbergen, both of Belgium

[73] Assignee: The Procter & Gamble Company, Cincinnati, Ohio

[21] Appl. No.: 891,819

[22] Filed: Jul. 30, 1986

[30] Foreign Application Priority Data

Aug. 1, 1985 [GB] United Kingdom ..... 8519363

[51] Int. Cl.[4] ..... D06M 13/36

[52] U.S. Cl. ..... 252/8.8; 252/525; 252/528; 252/174.16; 252/DIG. 17; 252/8.6; 252/547; 252/8.9

[58] Field of Search ..... 252/528, 174.16, 8.8, 252/8.9, 525, DIG. 17, 8.6; 8/188

[56] References Cited

U.S. PATENT DOCUMENTS

| | | | |
|---|---|---|---|
| 2,758,093 | 8/1956 | Ernst et al. | 252/174.16 |
| 3,516,937 | 6/1970 | Story et al. | 252/110 |
| 3,709,836 | 1/1973 | Inamorato | 252/525 |
| 3,957,661 | 5/1976 | Verite | 252/8.9 |
| 3,966,629 | 6/1976 | Dumbrell | 252/140 |
| 4,014,800 | 3/1977 | Kleber | 8/188 |
| 4,220,562 | 9/1980 | Spadini et al. | 252/542 |
| 4,291,071 | 9/1981 | Harris et al. | 427/220 |
| 4,292,182 | 9/1981 | Jahn | 252/8.8 |
| 4,294,710 | 10/1981 | Hardy et al. | 252/8.8 |
| 4,321,157 | 3/1982 | Harris et al. | 252/174.25 |
| 4,338,204 | 7/1982 | Spadini et al. | 252/8.75 |
| 4,375,416 | 3/1983 | Crisp et al. | 252/8.7 |

FOREIGN PATENT DOCUMENTS

| | | |
|---|---|---|
| 000225 | 6/1978 | European Pat. Off. . |
| 1400898 | 7/1975 | United Kingdom . |
| 1514276 | 6/1978 | United Kingdom . |

OTHER PUBLICATIONS

Pending U.S. Ser. No. 843,321, Baeck et al., filed 3/24/86.

*Primary Examiner*—Paul Lieberman
*Assistant Examiner*—John F. McNally
*Attorney, Agent, or Firm*—Donald E. Hasse; Thomas H. O'Flaherty; Richard C. Witte

[57] ABSTRACT

Amines and phosphates esters and amine oxides are combined to provide water-insoluble, water-dispersible fabric softeners. The softeners are formulated in a variety of laundry compositions.

12 Claims, No Drawings

DISPERSIBLE FABRIC SOFTENERS

TECHNICAL FIELD

The present invention relates to waterdispersible fabric softening compositions comprising a fatty amine, a fatty acid phosphate ester, and an amine oxide. Detergent compositions containing said fabric softener compositions are disclosed. The dispersible fabric softener compositions are particularly suited to be incorporated in a granular detergent composition in a process comprising addition of the composition to an aqueous slurry of detersive ingredients and subsequent drying.

BACKGROUND

The use of softeners to treat fabrics after a washing operation is a well-known laundering practice. Fabric softeners are, in the main, water-insoluble cationic materials that are incompatible with anionic detersive surfactants used in most fabric washing compositions. For that reason, the softening operation is generally carried out in the laundry rinse bath after the surfactant has been removed from the washing machine. This entails additional work for the user.

Formulators of fabric laundering compositions have long sought means whereby fabric washing and softening could be done concurrently. Laundering methods employing clay softeners, mixtures of clays and various amine materials and the like, are described in the following patents: German Nos. 29/64114.3. 28/57163.3. 24/39541.3. 23/34899.4 and EPO Nos. 80200570.2. 80200877.1 and 80201015.7. The use of mixtures of amines and soaps (salt of fatty acids) as through-the-wash softeners is disclosed in U.K. Pat. No. 1.514.276.

The prior art also discribes the use of various cationic materials in sheet form. See U.S. Pat. No. 4.220.562. The prior art also teaches the softener use of alkyl phosphonate and quaternary ammonium compounds. EPO Application No. 0 006 268, filed June 11, 1979.

The prior art also teaches various mixtures of phosphate esters in detergents with fabric softening action—BE 802.679.

SUMMARY OF THE INVENTION

The present invention relates to water-dispersible fabric softening compositions comprising an amine, a phosphate ester, and an amine oxide. These fabric softening compositions are suitable for use in conjunction with detersive ingredients, to provide through-the-wash softening.

The invention also encompasses detergent compositions (preferably granular) which may be described succinctly as containing conventional detergent ingredients such as detersive surfactants (including anionics), detergency builders, optical brighteners, detersive enzymes, fabric bleaches, and the like, all at rather conventional levels, as well as clay fabric softeners (preferably, smectite clays), said compositions being characterized in that they contain at least 0.1% (preferably 1.0% to 15%) of the fabric softener composition herein. The most preferred compositions with clay are formulated to contain not more than 5% (preferably not more than 1%–2%) of a nonionic detersive surfactant.

The invention also encompasses an article for use in a laundry bath or rinse bath, or in a laundry dryer, comprising the aforesaid amine/phosphate ester/amine oxide fabric softener composition releasably affixed to a water-insoluble carrier, for example, a sheet of paper or fabric. Such compositions are optionally formulated to contain a bleach activator and such activator-containing compositions are especially useful in laundry baths. The ingredients and means for preparing the compositions are disclosed more fully hereinafter. All weights and proportions are by weight, unless otherwise specified.

DETAILED DESCRIPTION OF THE INVENTION

The water-dispersible fabric softener compositions herein contain an amine, a phosphate ester, and an amine oxide, each of which will be disclosed more fully hereinbelow.

Amines

The amines employed herein are of the formula $R_1R_2R_3N$ where $R_1$ is $C_6$ to $C_{20}$, $R_2$ is $C_1$ to $C_{20}$ hydrocarbyl, preferably alkyl or hydrogen, and $R_3$ is $C_1$ to $C_{10}$ hydrocarbyl, preferably alkyl, or hydrogen.

Preferably, the amines have both $R_1$ and $R_2$ as $C_6$–$C_{20}$ alkyl, with $C_{16}$–$C_{18}$ being most preferred, and with $R_3$ as $C_1$–$C_3$ alkyl. Mixed amines, such as dicoconutalkyl- and ditallowalkyl-methyl amines can be used. Such materials are commercially available under Trade Marks such as "Armeen".

Phosphate Ester

The phosphate esters which are critical to the practice of this invention are commercially available materials of the general formulae:

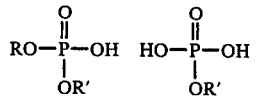

wherein R and R′ are $C_1$–$C_{20}$ alkyl or (preferably) ethoxylated alkyl groups of the general formulae: alkyl-$(OCH_2CH_2)_Y$, wherein the alkyl substituent is $C_1$–$C_{20}$ preferably $C_8$–$C_{16}$ and Y is an integer of 1 to 15, preferably 2–10, most preferably 2–5. Such compounds are prepared by known methods from phosphorus pentoxide, phosphoric acid or phosphorus oxy halide and alcohols or ethoxylated alcohols.

It will be appreciated that the formulae depicted represent mono- and di-esters, and commercial phosphate esters will generally comprise mixtures of the mono- and di-esters, together with some proportion of tri-ester.

Typical commercial esters are available under the Trade Marks "Phospholan" PDB3 (Diamond Shamrock) and "Servoxyl" VPAZ (Servo).

Amine Oxides

The amine oxide component of the fabric softener composition has the general formula

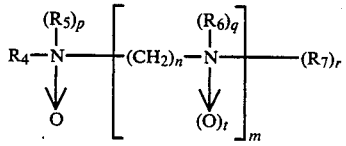

wherein $R_4$ is $C_{10}$ to $C_{22}$ alkyl or alkenyl, $R_5$, $R_6$ and $R_7$ are selected from $C_1$–$C_4$ alkyl, ethylene oxide and propylene oxide, n is an integer from 1 to 6, m is an integer from 0 to 6, t is 0 or 1, p, q, and r are each 1 for alkyl substituents, and integers in the range from 1 to 10 for ethylene oxide or propylene oxide substituents, such that the sum of (p+q+r) is not greater than 25.

Prefered amine oxides for use herein are defined by the following substituents:

$R_4$: hydrogenated tallow $C_{16-18}$ alkyl, coconut $C_{12}$–$C_{14}$ alkyl.

$R_5$, $R_6$, $R_7$: ethylene oxide, methyl, ethyl.

m: 0 or 1.

n: 3 (assuming m is different from 0), p, q, r are each at least 1 and their sum is in the range from 2 to 12, for example 2, 3, 7 and 12.

One particularly preferred class of amine oxide species is represented by mono-amine oxides having the following substituents.

m: 0.

$R_5$, $R_6$, $R_7$: methyl, ethyl, ethylene oxide.

$R_4$: coconut $C_{12}$–$C_{14}$ alkyl, p and q are both 1,

A specific example of this preferred class of mono-amine oxides is: N-$C_{12}$–$C_{14}$ coconut alkyl-N,N-dimethyl amine oxide.

Another particularly preferred class of amine oxide species is represented by bis-amine oxides having the following substituents.

m: 1.

$R_4$: tallow $C_{16}$–$C_{18}$ alkyl, palmityl, oleyl, stearyl.

$R_5$, $R_6$, $R_7$: ethylene oxide.

n: 2 or 3.

p, q and r: are each at last 1, and their sum is from 3 to 12.

A specific example of this preferred class of bisamine oxides is: N-hydrogenated $C_{16}$–$C_{18}$ tallow alkyl-N,N',N'-tri-(2-hydroxyethyl)-propylene-1,3-diamine oxide.

In the fabric softener compositions the weight ratio amine:phosphate ester is at least 5:1, preferably from 5:1 to 20:1, most preferably from 7:1 to 15:1. The weight ratio amine:amine oxide is at least 1:1, preferably from 1:1 to 20:1, most preferably from 7:1 to 15:1.

The invention also encompasses detergent compositions containing at least 0.1 weight %, preferably from 1 to 15 weight % of the fabric softener composition Preferably, the detergent compositions are in granular form. The detergent compositions typically contain conventional detersive ingredients, like detersive surfactants and detersive adjuncts, at conventional levels. Particularly preferred are compositions that further contain softener clay as an additional fabric softening ingredient.

DETERSIVE SURFACTANTS

The detergent compositions of this invention will contain organic surface-active agents ("surfactants") to provide the usual cleaning benefits associated with the use of such materials.

Detersive surfactant useful herein include well-known synthetic anionic, amphoteric and zwitterionic surfactants. Typical of these are the alkyl benzene sulfonates, alkyl- and alkylether sulfates, paraffin sulfonates, olefin sulfonates, alpha-sulfonates of fatty acides and of fatty acid esters, and the like, which are well-known from the detergency art. In general, such detersive surfactants contain an alkyl group in the $C_9$–$C_{18}$ range: the anionic detersive surfactants can be used in the form of their sodium, potassium or triethanolammonium salts. U.S. Pat. No. 4.111.855 contains detailed listings of such typical detersive surfactants. $C_{11}$–$C_{16}$ alkyl benzene sulfonates, $C_{12}$–$C_{18}$ paraffin-sulfonates and alkyl sulfates are especially preferred in the compositions of the present type. Also useful herein as the surfactant are the water-soluble soaps, e.g. the common sodium and potassium coconut or tallow soaps well-known in the art.

It is to be understood that the use of typical alkoxylated nonionic surfactants (e.g. the $C_9$–$C_{18}$ alkyl) alcohols and alkyl phenols with 5 to 20 ethoxyl groups are preferably limited in the practice of this invention to levels of not more than about 5%, preferably not more than 2%, most preferably 0–1%, of the compositions when clay is present as a co-softener, since alkoxylates can interfere with the softening properties of clay. In clay-free compositions, the alkoxylated nonionics can be used at any desired level.

The surfactant component can comprise as little as 1% of the laundry detergent compositions herein, but generally the compositions will contain 5% to 40%, preferably 6% to 30%, of surfactant. Mixtures of the anionic, such as the alkyl benzene sulfonates, alkyl sulfates and paraffin sulfonates are preferred for through-the-wash cleansing of a broad spectrum of soils and stains from fabric.

DETERSIVE ADJUNCTS

The compositions herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitrilotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylene diaminetetraacetate, the amino-polyphosphonates and phosphates (DEQUEST) and a wide variety of other poly-functional organic acids and salts too numerous to mention in detail here. See U.S. Pat. No. 3.579.454 for typical examples of the use of such materials in various cleaning compositions. In general, the builder/sequestrant will comprise 0.5% to 45% of the composition. The 1–10 micron size zeolite (e.g. zeolite A) builders disclosed in German Pat. No. 24 22 655 are especially preferred for use in low-phosphate compositions which contain the softeners described herein.

The laundry compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (preferably a mixture of amylase and protease) are typically used at levels of 0.001% to 2% and higher, in the prevent compositions.

Moreover, the compositions herein can contain, in addition to ingredients already mentioned, various other optional ingredients typically used in commercial products to provide aesthetic or additional product performance benefits. Typical ingredients include pH regulants, perfumes, dyes, bleaches, optical brighteners, soil suspending agents, hydrotropes and gel-control agents, freeze-thaw stabilizers, bactericides, preservatives, suds control agents, bleach activators and the like.

In a through-the-wash laundry mode, the compositions are typically used at a concentration of at least 500 ppm, preferably 0.10% to 2.5% in an aqueous laundry bath at pH 7–11 to launder fabrics The laundering can be carried out over the range from 5° C. to the boil, with excellent results.

SOFTENER CLAY

The above-disclosed amine-phosphate ester-amine oxide softeners are preferably used in granular detergent compositions in combination with a detergent-compatible clay fabric softener. Such clay softeners are well-known in the detergency patent literature and are in broad commercial use, both in Europe and in the United States.

Included among such clay softeners are various heat-treated kaolins and various multi-layer smectites. Preferred clay softeners are smectite softener clays that are described in German patent document No. 23 34 899 and in U.K. Pat. No. 1.400.898 which can be referred to for details. Softener clays are used in the preferred compositions at levels of at least 1%, generally 1–20%, preferably 2–7%.

In an alternate mode, the amine-phosphate ester-amine oxide softeners herein may be releasably adsorbed or releasably coated onto a non-particulate substrate such as a non-woven or paper sheet or flexible sponge mat, or the like. Such sheet-form objects may be added to the laundry or rinse bath, or to the laundry dryer, where the softener is released to provide fabric softening. In an alternate, and highly preferred, mode the amine-phosphate ester softener is used in sheet form in combination with a bleach activator (such as tetraacetyl ethylene diamine or a straight- or branched-chain $C_6$–$C_{10}$ oxybenzene sulfonate) as a combined perborate-activator and softener in a laundry liquor. See, for example U.S. Pat. No. 4.220.562.

Such sheet form products will generally employ 1–20 grams of the amine-phosphate ester softener and 1–20 grams of the bleach activator.

In still another mode, the amine-phosphate ester-amine oxide can be formulated as a liquid fabric softener and used in a post-laundry rinse bath. Such liquid softeners can comprise, for example, a simple dispersion of the amine-phosphate ester-amine oxide softener in water or water-alcohol.

In general terms, the amine-phosphate ester-amine oxide softeners are prepared separately from the balance of the compositions, and are preferably then added to the other, conventional ingredients to provide the final formulations. This can most conveniently be done by preparing a melt of the phosphate ester and the amine, adding the normally liquid amine oxide, and maintaining the melt stage for a few minutes. The melt can then be layered onto a sheet substrate to prepare, for example, a dryer-added fabric softener. To prepare a detergent, the melt can be dispersed into a stirred, aqueous crutcher mix comprising the balance of the detersive ingredients, and spray-dried in standard fashion.

It is, in fact, an important advantage of the present fabric softener compositions that it can be added to an aqueous crutcher mix of detergent ingredients without substantial loss of fabric softening properties. It has been found that softener compositions comprised of the amine component and the phosphate ester component (i.e., without the amine oxide), although having substantial fabric softening properties, lose a significant portion of their fabric softening properties if incorporated in a detergent composition via addition to an aqueous crutcher mix.

An important aspect of the fabric softener compositions of the present invention is that they can be added to an aqueous crutcher mix without a significant loss of fabric softening performance characteristics. Hence, the problems of appearance (yellowing) and flow characteristics (caking), frequently associated with spray-on addition of major amounts of organic material, can be avoided.

INDUSTRIAL APPLICATION

The following examples are typical of the preferred compositions of this invention, but are not intended to limit the scope of the invention.

EXAMPLE 1

A mix of ditallow methyl amine (total 3.8% of complete formulation after spray-drying) and monococonutalkyl (ethoxy) 1–5 phosphoric acid ester (0.38% of complete formulation) are admixed and melted in a jacketed bath. Coconut N,N dimethyl amine oxide (0.42% of complete formulation) is then added. Stirring assures homogeneity.

A standard aqueous crutcher mix comprising the following ingredients is prepared (percentages listed relate to percent ingredients in the complete formulation after spray-drying).

| Ingredients | Percent |
|---|---|
| $C_{11-12}$ alkyl benzene sulfonate | 6.2 |
| Tallow alcohol ethoxylate (EO11) | 1.0 |
| Sodium tripolyphosphate | 24.0 |
| Sodium sulfate | 22.0 |
| Sodium silicate | 8.0 |
| Smectite Clay* | 2.4 |
| Carboxymethyl cellulose | 0.4 |
| Polyacrylate (soil suspender) | 1.7 |
| Enzymes*** | 0.5 |
| Optical brightener | 0.23 |
| sodium perborate*** | 20.0 |
| Sulphonated zinc phthalocyanine** | 25 ppm |
| EDTA | 0.2 |
| Perfume**** | 0.2 |
| Water and minors | to 100 |

*Natural smectite: ion exchange capacity above 50 meq/100 g clay:
**U.S. Pat. No. 3 927 967
***Dry-mixed with composition
****Sprayed onto composition after spray-drying and dry-mixing The pre-formed softener is poured into the stirred aqueous crutcher mix (60°–90° C.). The crutcher mix-plus-softener is then handled in entirely standard fashion, and spray-dried.

The composition of Example I is free-flowing and provides excellent cleaning and through-the-wash fabric softening when used at laundry concentration of 0.1% and above.

The composition of Example I may be modified by dry-mixing 1.0% tertraacetyl ethylenediamine (TAED) as a perborate bleach activator. The composition may be modified further by also adding monotallowalkyl trimethylammonium chloride as 2.4% of the total composition.

EXAMPLE 2

A low- P spray-dried detergent formulation is as follows:

| Ingredients | Percent |
|---|---|
| Zeolite A (1–10 micron) | 26.0 |
| Sodium nitrilotriacetate | 5.0 |

-continued

| Ingredients | Percent |
|---|---|
| Smectite clay* | 3.0 |
| Amine-phosphate Ester-amine oxide** | 4.1 |
| $C_{11-12}$ alkyl benzene sulfonate (Na) | 6.5 |
| Tallow ethoxylate (EO 9-11) | 0.5 |
| Sodium Perborate $4H_2O$*** | 20.0 |
| Sodium silicate | 8.0 |
| CMC | 1.0 |
| Sodium sulfate | 20.0 |
| Enzymes (1:1 amylase/protease)*** | 1.5 |
| Optical brightener | 0.5 |
| Water, minors | to 100 |

*As Gelwhite GP( TM ): $CaCO_3$ ion exchange capacity 70 Meq/100 g.
**As in Example I.
***Dry-mixed with composition.

The composition of Example II is prepared by spray-drying an aqueous crutcher mix, in the manner described for Example I. In use, the composition gives excellent cleaning and through-the-wash fabric softening performance.

EXAMPLE III

A laundry additive product is prepared by warming 6.5 g of bis(tetradecyl)methyl amine and 0.8 g of tetradecylphosphate to form a melt adding N,N',N'-tri-(2-hydroxyethyl)-propylene-1,3-diamine oxide, and spreading the melt onto an ordinary disposable paper hand-towel (20×20 cm), 4 grams of TAED powder (1-10 microns) are sprinkled onto and pressed into, the melt before it has the chance to solidify.

The article of Example III is added to a laundry liquor containing a commercial perborate/clay detergent composition (DASH-3: Trade Mark) to enhance through-the-wash softening and bleaching performance.

EXAMPLE IV

The article of Example III is modified by deleting the TAED and replacing the Example III softener with 3.5 g. of the amine-phosphate ester-amine oxide softener of Examples I and II. The resulting article is tumbled with damp fabrics in a standard hot air clothes dryer, whereby the softener is transferred to the fabrics to impart softness.

We claim:

1. A water-dispersible fabric softening composition comprising:

(a) an amine of the formula $R_1$, $R_2$, $R_3N$ wherein $R_1$, is $C_6$ to $C_{20}$ alkyl, $R_2$ is $C_1$ to $C_{20}$ alkyl or hydrogen, and $R_3$ is $C_1$ to $C_{10}$ alkyl or hydrogen;

(b) a phosphate ester of the formula

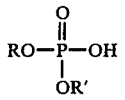

wherein R' is $C_1$-$C_{20}$ alkyl, or alkoxylated alkyl of the formula alkyl $-(OCH_2CH_2)_Y$, wherein the alkyl substituent is $C_1$-$C_{20}$, and Y is an integer from 1 to 15, and R is R' or hydrogen, and (c) an amine oxide of the formula

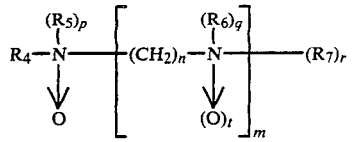

wherein $R_4$ is $C_{10}$-$C_{22}$ alkyl or alkenyl, $R_5$, $R_6$ and $R_7$ are selected from $C_1$-$C_4$ alkyl, ethylene oxide and propylene oxide, n is an integer from 1 to 6, m is an integer from 0 to 6, t is 0 or 1, p, q and r are each 1 for alkyl substituents, and integers in the range from 1 to 10 for ethylene oxide or propylene oxide substituents such that the sum of (p+q+r) is not greater than 25, wherein the weight ratio of amine:phosphate ester is from 5:1 to 20:1 and the weight ratio amine:amine oxide is from 1:1 to 20:1.

2. The fabric softening composition of claim 1 wherein both $R_1$ and $R_2$ are $C_{16}$-$C_{18}$ alkyl.

3. The fabric softening composition of claim 1 wherein m=0 and $R_5$ and $R_7$ are $C_1$-$C_4$ alkyl.

4. A fabric composition according to claim 1 wherein the weight ratio amine:phosphate ester is from 7:1 to 15:1, and the weight ratio amine:amine oxide is from 7:1 to 15:1.

5. A laundry detergent composition comprising conventional detersive ingredients, characterized in that it contains at least 0.1% of the fabric softening composition of claim 1.

6. A composition according to claim 5 which contains from 1% to 15% of the fabric softening composition.

7. A composition according to claim 6 which further contains at least 1% of a clay fabric softener.

8. A composition according to claim 1 which contains a detergency builder selected from phosphate, nitrilotriacetate, polycarboxylate, citrate and zeolite builders, or mixtures thereof.

9. An article for use in a laundry or rinse bath, or in a laundry dryer, comprising a non-particulate substrate, preferably a flexible sheet, having releasably affixed thereto a fabric softener composition according to claim 1.

10. An article according to claim 9 which additionally comprises a bleach activator.

11. A method of softening fabrics which comprises contacting said fabrics with a composition according to claim 1 in the presence of water.

12. A process for preparing a granular detergent composition according to claim 5 whereby the fabric softening composition is pre-formed as a melt and is added to an aqueous slurry containing some or all of the conventional detersive ingredients.

* * * * *